US009580769B2

(12) United States Patent
Reis et al.

(10) Patent No.: US 9,580,769 B2
(45) Date of Patent: Feb. 28, 2017

(54) DEVICE FOR THE IMPROVEMENT OF CRUDE PELLETS AND PELLETIZING PROCESS

(71) Applicant: VALE S.A., Rio de Janeiro (BR)

(72) Inventors: José Antonino Alves e Silva Reis, Vitória (BR); Reinaldo Walmir De Jesus, Vitória (BR); Aldo Gamberini Júnior, Vitória (BR); Leonidio Stegmiller, Vitória (BR)

(73) Assignee: Vale S.A., Rio de Janeiro (BR)

( * ) Notice: Subject to any disclaimer, the term of this patent is extended or adjusted under 35 U.S.C. 154(b) by 172 days.

(21) Appl. No.: 14/520,062

(22) Filed: Oct. 21, 2014

(65) Prior Publication Data

US 2015/0128766 A1 May 14, 2015

Related U.S. Application Data

(60) Provisional application No. 61/894,174, filed on Oct. 22, 2013.

(51) Int. Cl.

| | |
|---|---|
| ***C22B 1/216*** | (2006.01) |
| ***B01F 9/02*** | (2006.01) |
| ***F27B 7/00*** | (2006.01) |
| ***F27B 7/20*** | (2006.01) |
| ***F27B 7/42*** | (2006.01) |
| ***C22B 1/24*** | (2006.01) |

(52) U.S. Cl.

CPC ..... *C22B 1/2406* (2013.01); *B01F 9/02* (2013.01); *C22B 1/216* (2013.01); *C22B 1/2413* (2013.01); *F27B 7/00* (2013.01); *F27B 7/20* (2013.01); *F27B 7/42* (2013.01)

(58) Field of Classification Search

CPC ..... C22B 1/2406; C22B 1/2413; C22B 1/216; B01F 9/02; B01F 15/0019; F27B 7/00; F27B 7/20; F27B 7/42

See application file for complete search history.

(56) References Cited

U.S. PATENT DOCUMENTS 2,711,557 A * 6/1955 Russell ..... C22B 1/2406 23/313 FB
2,728,940 A * 1/1956 Yesberger ..... C22B 1/2406 23/313 R

FOREIGN PATENT DOCUMENTS

GB 719256 A * 12/1954 ..... C22B 1/2406

* cited by examiner

*Primary Examiner* — George Wyszomierski
*Assistant Examiner* — Tima M McGuthry Banks
(74) *Attorney, Agent, or Firm* — Arent Fox LLP

(57) ABSTRACT

A pelletizing process, having two distinct serial stages. In the first stage, crude (or green) pellets of a given ore, or a mixture of ores (such as iron ore, manganese ore and other minerals), are produced, while in the second stage, a Device for Improvement of Crude Pellets, is used. The Device includes a slightly elastic and smooth surface, with reduced attrition rate, that may be striated, and that, encircled in itself, forms a cylindrical geometric hollow figure supported by a metallic structure, also cylindrical, with the set forming a finishing drum. The Device rotates with an inner and continuous charge of ore pellets, and can rearrange the structure of such pellets, improving their physical quality: compressive strength, sphericity and surface finishing, and assimilate fines generated during previous processes. This device allows application of diverse materials to the pellets to add required extra properties per specificities of subsequent industrial processes.

22 Claims, 6 Drawing Sheets

DEVICE FOR THE IMPROVEMENT OF CRUDE PELLETS AND PELLETIZING PROCESS

CROSS-REFERENCE TO RELATED APPLICATION(S)

The present application is a non-provisional of and claims priority to U.S. Provisional Application No. 61/894,174, filed on Oct. 22, 2013, the entirety of which is incorporated herein by reference.

FIELD OF THE INVENTION

The present invention refers to an ore pelletizing process which comprises two distinct serial stages.

SUMMARY OF THE INVENTION

The present invention describes a pelletizing process that is conspicuously conducted in two distinct serial stages. In the first stage, a given type of ore or a mixture of ores (such as iron ore, manganese ore and other minerals) is used to produce crude (or green) pellets through conventional ways, using conventional equipment for the generation and production of crude (or green) ore pellets, whereas in the second stage a Device for the Improvement of Crude Pellets (henceforth, DICP) is applied. The DICP comprises a rotary drum which works at room temperature, providing induration and conformation to crude (or green) pellets. The DICP adds compressive and abrasion resistance to pellets, in addition to other benefits such as the reduction of fines and seeds, reduction in the recirculation load rate and the resulting improved physical characteristics of pellets, such as higher spherality and compactness degree, and better surface finishing.

The DICP stage comprises a rotary electro-mechanical device with a cylindrical constructive arrangement essentially constituted by a slightly elastic and smooth low attrition rate inner surface that may be striated, which is called shaping surface and allows for significant improvement of crude pellets, and later on of thermally heated pellets physical quality.

An embodiment of the present invention also applies to processes aimed to obtain any other mineral or material that may lead to a final product whose components are entirely or partially spherically shaped and that are furthermore characterized by a remaining plasticity to enable processing.

The present invention also allows the homogeneous application of solid (finely ground), liquid or pasty materials to the surface of pellets, such as bauxite, coal, bentonite, and others aimed at incorporating other required properties into pellets before submitting them to a heat treatment or sinterization furnace, or desired properties for the subsequent industrial processes of interest that use mineral pellets or ore mixtures as raw material.

BACKGROUND OF THE INVENTION

According to the state of the art, as far as extracting and processing a given ore or a mixture of ores is concerned, fines from mines that cannot be directly fed into metal ore production furnaces are set apart for pelletization processes. In a typical pelletization process, these ore or mixtures of ore fines are subjected to a preliminary process through which their granulometry become even finer as they are either ground with fluxing agents or subjected to separate dosage and, lately, are subjected to a binder dosage aiming at agglutinating the particles.

Pellets are made by taking this previously homogenized mixture with adjusted moisture and subjecting it to the pelletization process using pieces of equipment that are known to the state of the art, which are often called pelletizing discs or pelletizing drums in which microfine particles are agglomerated to form pellets (usually called crude or green pellets), partially spherically shaped with medium diameter, as required for use in subsequent industrial processes.

Further, these pellets are then classified and fed into a heat treatment or sinterization furnace for induration.

During handling, inside the pelletization disc and during the loading process into the heat treatment or sinterization furnace, it is known that the green pellets are oftentimes damaged due to a number of factors such as the distance they have to cover, the height and number of falls they are subjected to, the speed of the transfer belts, counter-flow transfers, and many other factors.

At the end of the sinterization process, these pellets are furthermore classified for the removal of fines, and fired fines-free pellets are eventually used in subsequent industrial processes. Typically, in the case of iron ore, fired pellets are commonly used in the production of pig or sponge iron, both consisting of raw materials employed on the production of steel.

Within the above described process, the pelletization disc comprises a metallic disc or circular tray fitted with a rotary movement in the inclined plane and scraping devices that favor the formation and growth of seeds by means of rolling and binding motions, in addition to the incorporation of particles until a pellet-shaped product is obtained, while the ore is fed into the disc. As variables are adjusted over the course of this process, the goal is to secure an improved sphericity, within the desired granulometry specification, in addition to the intended diameter for pellets within a most favorable productive range for use in subsequent industrial processes.

Nevertheless, one of the inconvenient factors of the state of the art is that the continuous loading of ore and the continuous scraping process carried out at the bottom of the disc or tray, along with other mechanisms, end up contributing to a final product containing significant quantities of fines and also to pellets comprised outside the desired size range, which can amount to over 20% of the total mass of the material. This problem gets even worse when the disc or tray is replaced with a pelletization drum, which, by nature, holds a very high degree of recirculation load, which is equivalent to the percentage of below and above a certain particle size range that is routed back to the fragmentation and pelletization process, and can amount to up to 50% of the total mass of the material.

Another inconvenience of the state of the art is the difficulty in obtaining pellets with adequate sphericity degree. This is due to the fact that several mechanical and physical complex processes, already known by the state of the art, occur simultaneously during the time pellets are forming and growing in an environment containing a large mass of material. Among complex pelletization processes, nucleation, coalescence (or fusion) and stratification (see FIG. 1) stand out.

These mechanisms are adversely affected by various sources, including the action of both bottom and side scrapers, which are common in pelletization equipment, and that redirect the flow of pellets being formed. Disc inclination and rotation speed, as well as feed ore moisture, and the production itself are also factors that influence the quality of pellets. Furthermore, low porosity plays an important role in the resistance of the agglomerate and, therefore, should be obtained prior to the heat indurating process.

Another inconvenience of the state of the art is the difficulty in ensuring an appropriate and homogeneous compactness and organization of the ore grains that make up the pellets, leading to pellets friable points or internal areas, which are conducive to the generation and propagation of cracks as pellets are transported to the furnace. If, on one hand, the rolling motion time is fundamental for such compaction, on the other hand an excessive speed developed by pellets inside the discs may lead to a crack formation process in case these pellets collide with the disc sides.

Another inconvenience of the state of the art is the difficulty in ensuring pellets with a lower degree of roughness in relation to its surface finishing, thereby making them coarse and predisposing them to the generation of fines through abrasion during their transportation to the heat treatment or sinterization furnace, in addition to the generation of dust as they are moved after being fired. This, too, is due to the various simultaneous processes used in pellet formation, including ore feeding rate and moisture.

In order to allow the elimination or reduction these hindrances, various control methods have been proposed for the pelletization process, including the variation of parameters such as moisture, amounts and types of binding agents, rolling motion time, mass proportions and size distribution of the used fines, with each method carrying its own disadvantages.

The time and the conditions available for produced pellets to show a more spherical shape are not enough in conventional pelletizing discs or drums. Hence, if the rolling motion time is increased for these devices while being concomitantly fed with ores, and owing to the mechanisms for shaping the crude pellets, the average size of such pellets increases without the occurrence of the corresponding appropriate sphericity, this being one of the identified disadvantages.

The state of the art also comprises the description of multiple-stage pelletization processes. However, oftentimes some of the disadvantages of such processes are the need to interrupt the processing flow due to the inclusion of additional phases for transporting and reloading pieces of equipment or the need for the assembly identical large-size equipment series or circuits, thereby leading to burdens associated with the use of space and resources.

Therefore, notwithstanding the control methods predicted by the state of the art aimed at improving pelletization processes, there remains in the state of the art the need to overcome the problems associated with these processes in order to obtain more compact and homogeneous ore or ore mixture pellets, without increasing the rolling motion time or volume, ensuring a decreased generation of fines, and using a fewer number of stages and less complex equipment.

Surprisingly, the present invention discloses that the use of a two-stage pelletization process in which an additional treatment stage following pellets generation and the preliminary production in pelletizing discs or drums result in an improved physical quality of crude ore or ore mixture pellets, thereby mitigating the inconveniences of the state of the art.

BRIEF DESCRIPTION OF THE DRAWINGS

The present invention shall be further discussed regarding attached figures.

DETAILED DESCRIPTION OF THE INVENTION

Figure 1:
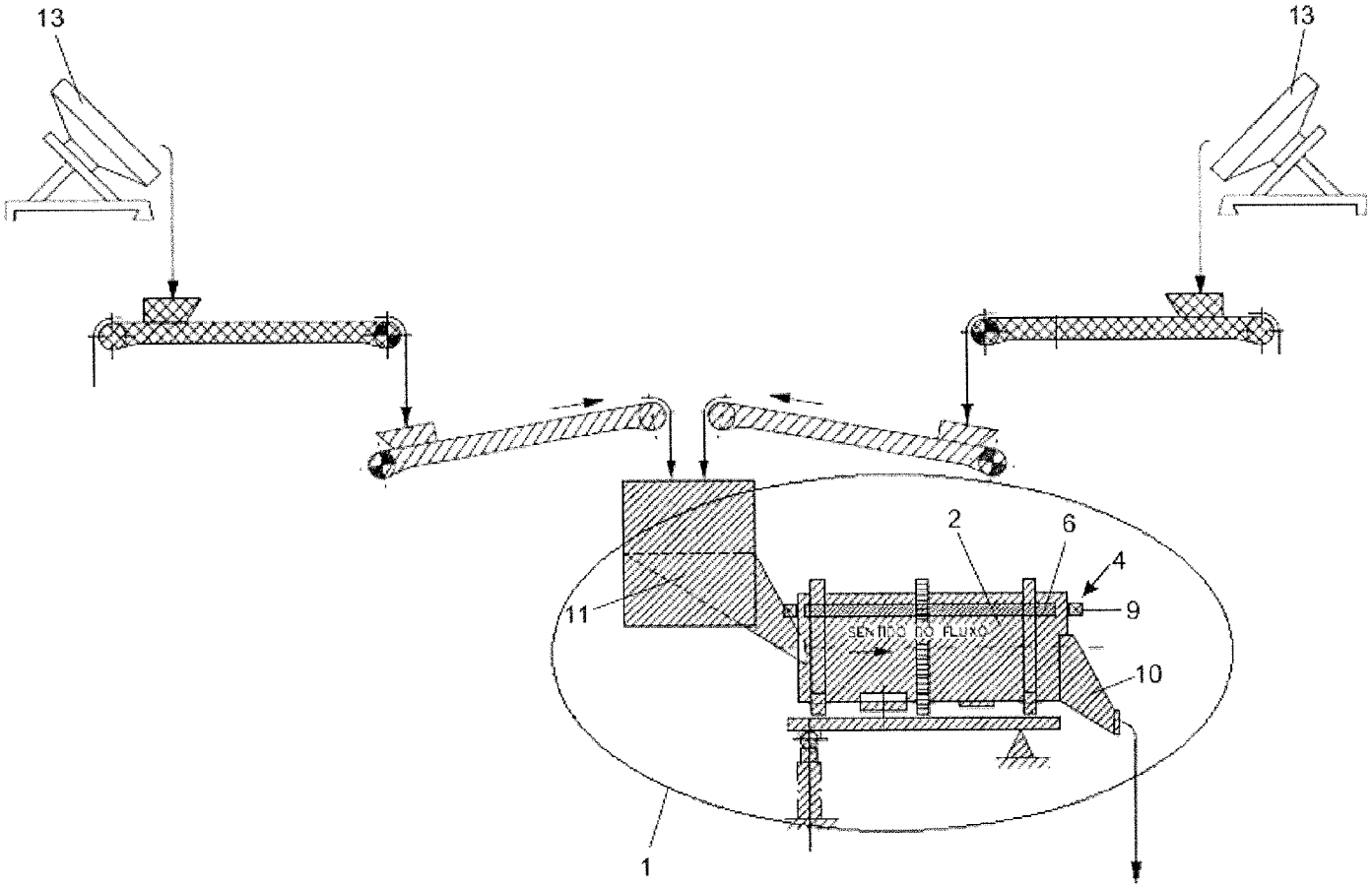
FIG. 1 is a representative illustration of the present invention two-stage pelletization process, showing the arrangement between two given pelletizing disc, for the first preliminary pellet production stage, and a Device for the Improvement of Crude Pellets, DICP, represented by a finishing drum for the additional pellet treatment stage.
Figure 2:
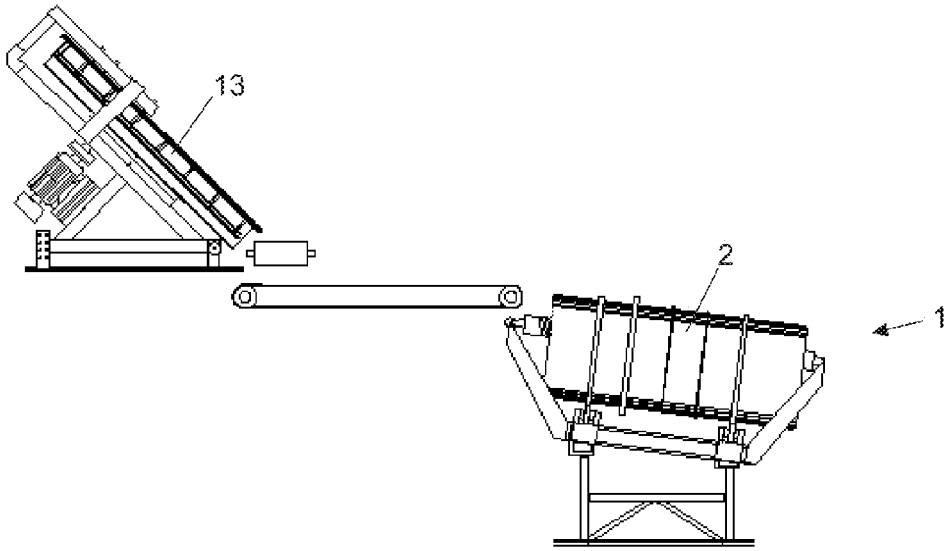
FIG. 2 is a representative illustration of the present invention two-stage pelletization process, showing the arrangement between a giver pelletizing disc, for the first preliminary pellet production stage, and a Device for the Improvement of Crude Pellets, DICP, represented by a finishing drum for the additional pellet treatment stage.
Figure 3:
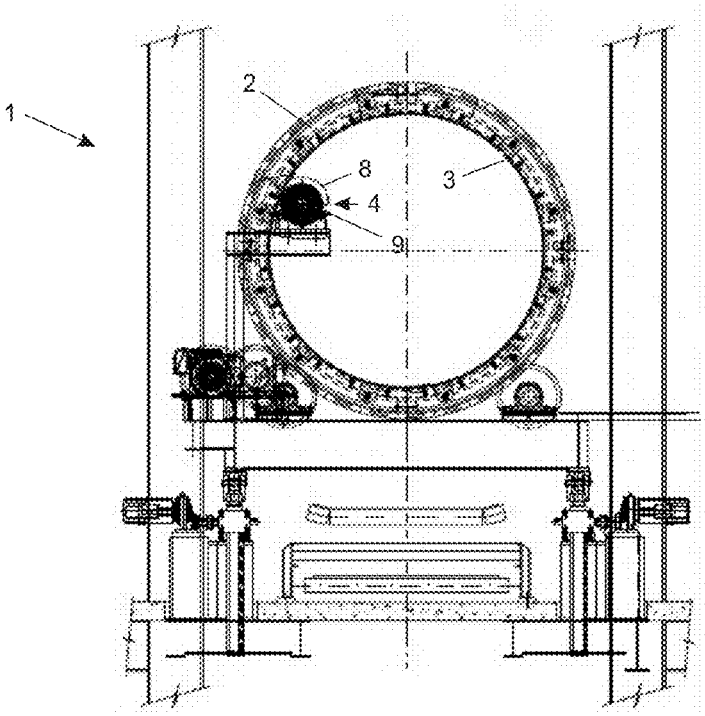
FIG. 3 illustrates DICP front view, pointing out the rotary drum, the cleaning system and the innermost surface.
Figure 4:
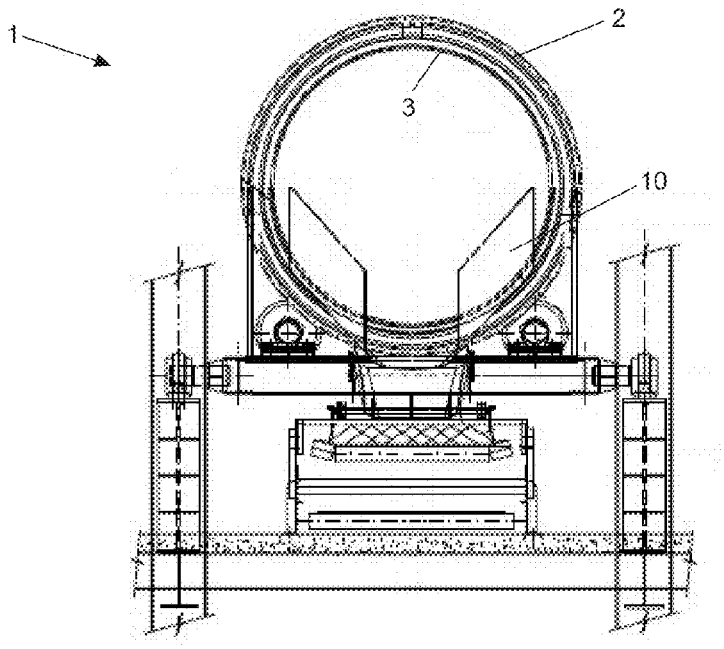
FIG. 4 illustrates the DICP back view, pointing out the rotary drum, the innermost surface and the discharge chute.
Figure 5:
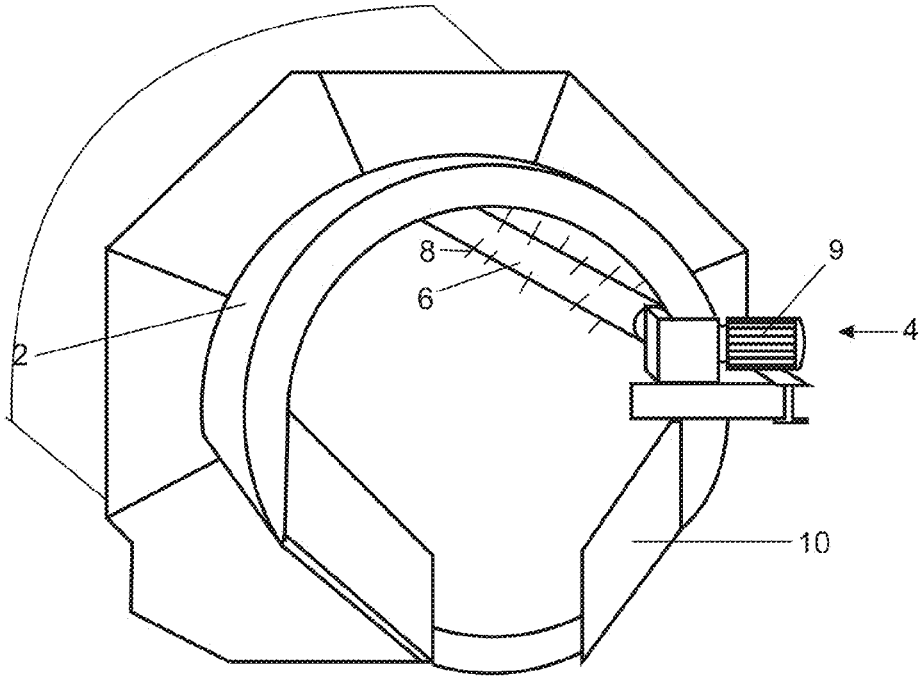
FIG. 5 illustrates DICP perspective back view, pointing out the position of the components of the cleaning system and the discharge chute.
Figure 6:
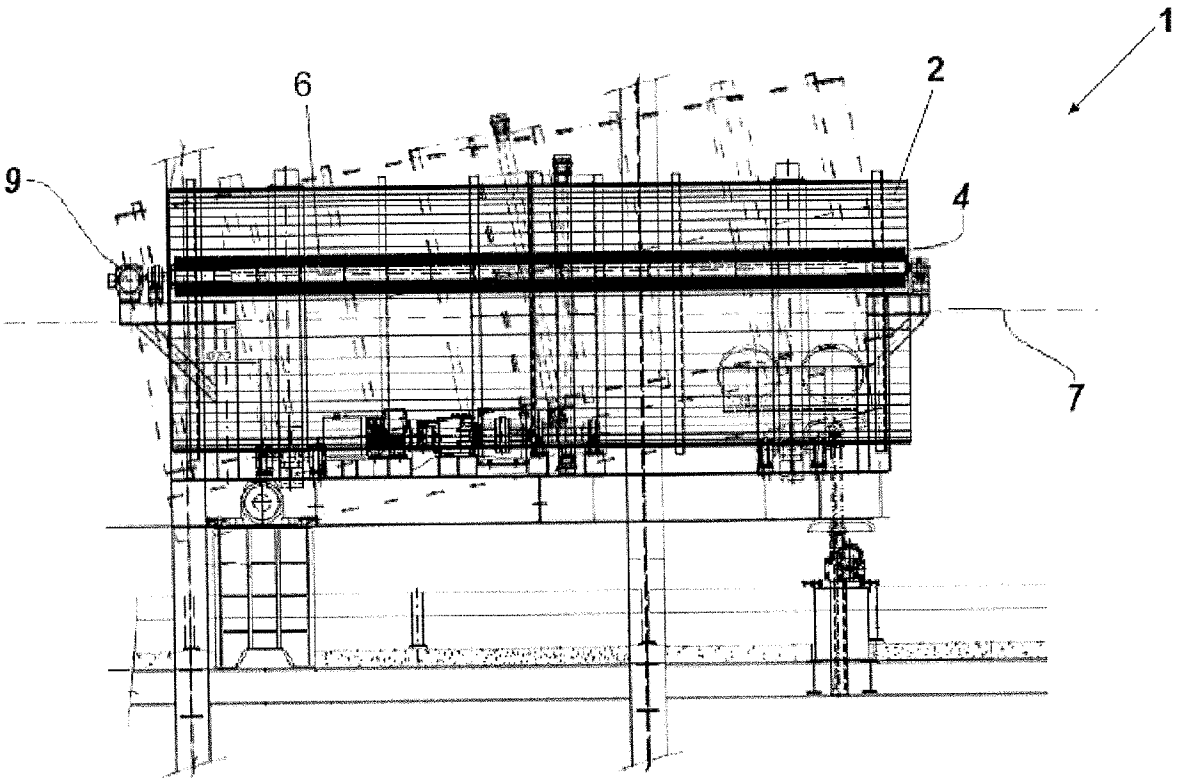
FIG. 6 illustrate DICP lateral view, pointing out how it inclines.

The main objective of the present invention two-stage pelletizing process is the production of mechanically more resistant green pellets as a result of a better compaction of grains, with potential gains as the recirculation load rate is decreased due to the incorporation of fines into crude pellets during the rolling motion time in a finishing drum 2, in addition to enabling the dry application of coatings on yet green pellets.

The two-stage pelletizing process comprises a first stage during which a conventional disc 13 is used for the formation of pellets, and a second stage at which pellets are additionally treated using a Device for the Improvement of Crude Pellets 1 (DICP). The DICP 1 comprises a finishing drum 2 whose internal surface 3 is smooth enough to ensure the rolling motion of formed pellets in order to improve the surface finishing, the compactness of pellets and the incorporation of whatever fines are still remaining on the surface of such pellets.

The DICP 1 comprises an appropriately sized rotary drum 2, hereinafter called "finishing drum" 2, fitted with a slightly inclined rotation axle in relation to the horizontal plane 7, with adjustable inclination, internally coated with partially adhesive and elastic material, fitted with a continuous cleaning system 4 for this coating and having variable rotation, inside which the iron or other mineral pellets generated by aforementioned pieces of equipment are rolled and transported.

The DICP 1 is placed after the pelletizing discs 13 or pelletizing drums 13, whose technology is recognized by the state of the art. Their jointly sequential operations comprise the process object of the present invention, herein called "Two-stage Pelletization", characterized by distinct crude or green pellet production phases, namely: during this first stage happens the generation and growth of seeds, either in pelletization drums or discs 13, and the subsequent formation of irregularly shaped pellets, roughly spherical, whereas the second stage is used for the final conformation of pellets, imparting them better physical characteristics, such as greater sphericity, compactness degree and better surface finishing.

All together, these features add to the pellets an enhanced physical strength, enabling them to be transported up to the location of the following phase, for heat treatment or sinterization, with reduced fragmentation rate, and reduced generation of fines thereby increasing the plant's productivity.

A larger degree of sphericity also allows for a better performance of the heat treatment process as it enables the formation of a more permeable load inside the furnace, with uniform distribution of gas flows, thereby exposing each pellet to a homogeneous submission of heat, and leading to the production of fired pellets with unique physical qualities, in addition to positively affecting subsequent industrial processes of interest.

An increased degree of compactness leads to the reduction of empty spaces of inappropriate sizes and to the reorganization of fragmented areas inside pellets, resulting in crude or fired pellets with high compressive strength, which is a prevailing property to guarantee low fragmentation rates during handling and transport to the pelletization furnace, in the case of crude pellets. In the case of fired pellets, the higher compressive strength helps maintaining the quality of the product during transport, even for long distances, to their final processing location.

Similarly, a better surface finishing reduces the abrasion rate, which, in addition to being very important, is also a prominent property that allows for performance gain of crude pellets during their transportation to the pelletization furnace. In the case of fired pellets, in handling and transporting them to the additional industrial processing location of interest, as it has a significant impact on the reduction of fines or dust generation resulting from abrasion mechanisms that happen between surfaces due to the relative movement among pellets.

Additionally, the DICP 1 also works towards aggregating fines (tiny grain particles) to the crude pellets. The fines are originated on the pelletizing discs or drums 13, and may also stem from mutual collision and abrasion among different pellets, during transference falls. The DICP 1 also works towards agglutinating part of the seeds prematurely expelled from the pelletizing discs or drums 13, thereby reducing the recirculation load rate.

This process increases pelletizing productivity and jointly with the aforementioned favorable characteristics incorporated to crude pellets adds to the pelletizing plant's productivity, reducing operational costs and leveraging the final product quality.

Finally, the DICP 1 also allows the application of diverse materials on pellets surface, should it be required by subsequent industrial processes of interest.

Therefore, one of the objectives of the present invention is to provide a Two-stage Pelletization Process that allows for the reabsorption of part of the fines that are generated and inherent to the crude pellet production process, thereby reducing recirculation load rates.

Another objective of the present invention is to provide a Two-stage Pelletization Process that allows for the reorganization of the ore grains and the rearrangement of friable areas and empty spaces inside crude pellets, making them more resistant to fragmentation during their transport to the heat treatment or sinterization furnace or as they move, after being fired, to the subsequent industrial processing locations of interest.

Another objective of the present invention is to provide a Two-stage Pelletization Process that allows for an improved rate of crude pellets sphericity in order to make them more suitable to the heat treatment process or to the sinterization furnaces, increasing their permeability and improving their performance, in addition to ensuring more spherical cured pellets, thereby positively affecting the subsequent industrial processes of interest.

Another objective of the present invention is to provide a Two-stage Pelletization Process that allows for the improvement of crude pellets surface finishing, making their surface smoother and less likely to releasing fragments when subjected to mutual abrasion, whether during their way to the sinterization furnace or as they are moved to the subsequent processing location after being cured.

Another objective of the present invention is to provide a Two-stage Pelletization Process that is conducive to the addition of other materials to the surface of pellets, in case it is required to improve subsequent industrial process of interest and/or to improve performance, thereby adding extra properties to pellets so as to meet subsequent processes specifications. These materials can be finely ground solids, liquids or pasty materials, such as, but not limited to, bauxite, bentonite, coal, oil and grease, among others, which are incorporated to the surface of pellets in order to provide them, after being cured, with extra properties such as low adhesion rate, greater aging resistance, additional mechanical resistance, and others advantages.

These and other objectives and advantages of the present invention are achieved through a Two-stage Pelletization Process for Improving the Physical Quality of Ore Crude Pellets, characterized by its two serial distinct stages. In the first stage, a given ore or a mixture of ores (such as iron ore, manganese ore and other minerals) are used to produce crude (or green) pellets using conventional equipment for the generation and production of crude (or green) ore pellets, whereas in the second stage the DICP 1 is used. The DICP 1 comprises a rotary drum 2 whose function is to confer induration and conformation to green pellets at room temperature, thereby adding compressive and abrasion strength to pellets, in addition to other benefits such as the reduction of fines and seeds, reduction of the recirculation load and the resulting improved physical characteristics of pellets, such as higher spherality and compactness degree, and better surface finishing.

The DICP 1 is an electromechanical device comprising a finishing drum 2, which in turn, consists in a rotary drum internally coated with a material whose surface 3 is partially adherent and elastic (for example, the same sort of rubber usually employed by the conveyor belt of a conveyor system), fitted with a cleaning system 4 for this surface 3 (for instance, a rotary broom), and that works as a shaping surface 3, in addition to appropriately designed feed and discharge chutes 11, 10, and that upon being incorporated into the ore crude pellets flow, after the latter have been produced and left the pelletizing discs or drums 13, promotes a restructuring of pellets while such pellets are still retaining some plasticity to allow for them to be worked on.

It is also part of the present invention the provision of a DICP 1 comprising a slightly elastic and smooth inner surface 3, bearing low attrition rate, called shaping surface 3. The shaping surface 3 that allows for significant improvement of pellets physical quality, and later on of heat treated pellets.

The design of the present invention also applies to processes aimed to obtain any other mineral or material that may lead to a final product whose components are entirely or partially spherically shaped and that are furthermore characterized by a remaining plasticity to enable processing.

The present invention also favors the homogeneous application of solid (finely ground), liquid or pasty materials to the surface of pellets, such as bauxite, coal, bentonite, and others aimed at incorporating into pellets other properties required to heat treatment or sinterization, or desired for subsequent industrial processes of interest that use mineral pellets or ore mixtures as raw material.

Below is a detailed description of the present invention ore pellets production process (or a ore mixture pellet production process), which is exemplified through the pellet production process using iron ore, though the present invention shall not be understood as restricted to this specific mineral.

At the first stage of a typical pelletization process, ore or ore mixtures fines are subjected to a preliminary phase for additional granulometry refining, also called comunition, through which microfine particles are formed. Then they are ground with fluxing agents or subjected to separate dosage and, eventually, are subjected to a binder dosage aimed at agglutinating particles. The fluxing agents used at this preliminary phase are selected from the group consisting of, but not limited to, limestone, dunite, calcium carbonate, alumina and magnesite. The binding agents used at this phase are selected from the group consisting of, but not limited to, calcium hydroxide, bentonite and an organic binder, such as carboxymethylcellulose.

For the second stage of the present invention pellet production process, it is employed the DICP 1, which comprises an elastic and smooth surface 3 with a static and dynamic attrition rate, preferably, but not limited to, about 0.05 to about 0.60. This surface 3 may be striated, in which case it is called shaping surface 3 that forms, encircling itself, a hollow cylinder-shaped geometric figure whose frame is supported by an equally cylindrical metallic structure. The aforementioned surface 3 constitutes one of the faces of a flexible plate characterized by its elastic material, with a thickness ranging, preferably, from, but not limited to, 5 to 30 mm, that is strong enough to support its form and integrity, conformed to the drum 2 and made of rubber, polyurethane, TEFLON® (polytetrafluoroethylene) or other similar products, either alone or in combination, and kept consistent by virtue of its own structure, fiber reinforcements or interweaved metallic frameworks in its inner side, comprising a coating inside the metallic cylindrical structure, which, as a set, is called finishing drum 2.

The finishing drum 2 longitudinal axle 7 is kept at a plane that may vary from a horizontal position to inclined positions in relation to the horizontal plane, with the angles ranging, preferably, but not limited to, 0 to 10°, with such positions being adjusted by an electromechanical mechanism comprising an electric motor and reducer. The finishing drum 2 is provided with variable rotation speed, ranging from, but not limited to, 0 to 12 rpm, and is driven by an electromechanical mechanism comprising an electric motor, reducer and frequency inverter.

The finish drum 2 is provided with an inner cleaning device 4, configured to wipe the shaping surface 3. The cleaning device 4 works on a continuous basis or pursuant to the adherence degree of the material on such surface 3. The aforementioned cleaning device 4 comprises a metallic shaft 6 set parallel with respect to the shaping surface 3, that is fitted with bristles 8 on its structure, preferably, but not limited to, metallic bristles 8, and that is located within the drum's upper semicircle area in such a way that, as it rotates and the bristles 8 gently touch the shaping surface 3, it guarantees, that the latter is kept clean. The above cited cleaning device 4 is also fitted with electromechanical mechanisms 9 that not only allow for its rotation speed to be changed from, preferably, but not limited to, 0 to 150 rpm, but also enable its distance from the shaping surface 3 to be adjusted in such a way as to ensure a permanent contact of the end of the bristles 8 with said surface 3.

The DICP 1 is also characterized by the fact that the finishing drum 2 ends are provided with feeding and discharge chutes 11, 10, made with low attrition and adherence rates material, such as, but not limited to, PTFE, compound PTFE, NYLON, UHMW, and HDPE. The feeding chute 11 directs the material flow tangentially in relation to the finishing drum's 2 shaping surface 3, while the discharge chute 10 redirects the material flow towards the finishing drum's 2 shaft, with both chutes 11, 12 allowing for fine-tuning their position.

The combination of rotation speed with the finishing drum 2 inclination, appropriate feed and discharge, in addition to keeping the shaping surface 3 always clean improves the pellet conformation, and, as a result, leads to its improved physical qualities, such as compression strength, sphericity and surface finishing, and also to the incorporation of part of the fine generated during such early processes as pelletization discs and drums 13.

Based on the presented definitions, the aforementioned resulting mix from the first stage, after being previously homogenized and having its moisture adjusted, is subjected to a pelletizing process with equipment known by the state of the art, usually called pelletizing discs or drums 13 in which said microfine particles are bound together to form pellets, which are also called crude or green pellets, whose shape are partially spherical with an average diameter as desired for possible subsequent industrial processes. The pelletizing discs or drums 13 used at this stage can work in different operation regimes, for example, the cascade type, the sliding type, or other regimes known to the state of the art, depending on the desired drum load capacity. In a preferred embodiment of the invention, the microfine particles are characterized by containing, preferably, without limitation, from 40% to 95% of its particles mass smaller than 0.045 mm. Pellets obtained during this present invention process stage are also characterized by their moisture content, ranging preferably, without limitation, from 8.0% to 11.0%.

It should be further highlighted that the second stage of the this present invention also allows the application of diverse materials to the surface of pellets in order to ensure their distribution, homogeneity and a thin film formation, whenever extra properties are sought for in these pellets based on the following industrial processes of interest.

At a later stage, these pellets are then classified through convention classification procedures of the state of the art, such as, for example, roller screens for the removal of undersize and oversize particles, selecting the fraction with average desired diameters of about 12 to about 13 mm. Both undersize and oversize particles are fragmented and compose the "Recirculation Load", and, therefore, are routed back to the pelletizing discs or drums 13 to be recycled.

On-size pellets are then subjected to the heat processing or sinterization furnace for induration.

Following the sinterization process, these pellets are still further classified by conventional classification equipments, appropriated for fines removal, which are often traded as "Sinter Feed" ore. Pellets of interest are fired and classified, and latter are employed in subsequent industrial processes of interest. Iron ore pellets, for instance, are used for the production of pig or sponge iron, which is further converted into steel.

Based on the above described process, the pelletizing disc 13 is, preferably, composed of a metallic round tray, with an approximate diameter of 6 to 7 meters, and an inclination ranging preferably from, but not limited to, 45° to 50° in relation to the horizontal plane, capable of rotating in the inclined plane at a variable rotation speed ranging from, but not limited to, 6 to 7 rpm. This disc 13 is further fitted with internal devices called scrapers, whose main function is to keep the bottom plane clean and smooth. The raw material is composed of highly moisturized ore which allows the formation and growth of seeds, through rolling motion and agglutination, and the incorporation of particles up to the condition of pellet, while the ore is being fed into the disc 13. As the variables involved in this process are adjusted the desired diameter can be achieved within an optimized production range.

A screen and a set of angle bars are welded on the metallic bottom of this equipment aimed to hold and retain the material to be deposited, thereby forming the bottom layer.

The material is then deposited as a layer on the disc bottom grate to protect the disc 13 against a potential contact with the metallic portion of the bottom and the scrapers, as well as to provide a plane and uniform traveling grate for the formation of pellets with greater sphericity, within the specified granulometry for the subsequent industrial processes of interest.

However, as it is known by those skilled in the art, generally and due to the various simultaneous processes interacting for the formation and growth of the pellets in the disc 13, the final size varies within a wide range, thereby requiring a series of size classification as noted above.

In spite of the above description and illustration for a preferred conception, it should be highlighted that changes in process and design are likely to occur and can be carried out without any deviation from this present invention scope.

A number of tests, object of this present invention, have been conducted aimed to allow for observing and assessing inherent mechanisms to the process, involved variables and the reproducibility of achieved properties.

The examples that follow illustrate the results of such tests that were conducted using iron ore pellets. Accordingly, in order to provide an example of this present invention preferred conception. The DICP 1, a rotating circular classifier sieve was used, which was adapted and coated with a rubber layer, for example, conveyor belt rubber, being the inner surface 3 rather smooth or striated.

Example 1

As an example of the present invention, without limitation however, the process was conducted as per the aforementioned general description, using an industrial disc 13 to simulate the effect of residence time on crude pellet porosity and density, changing its rotation speed at three levels (5.2-6.0-7.3 rpm). Samples collected from each test were subjected to both macro- and microstructural analyses in order to measure the intended effects.

The macrostructural analysis showed that pellets produced with 7.3 rpm tended to show greater diameter and smoother surface than those generated with 5.2 and 6 rpm. In addition to greater porosity, pellets with 6 and 5.2 rpm showed greater occurrence of satellites, or seeds, absorbed when compared to the 7.3 rpm.

Figure 8:
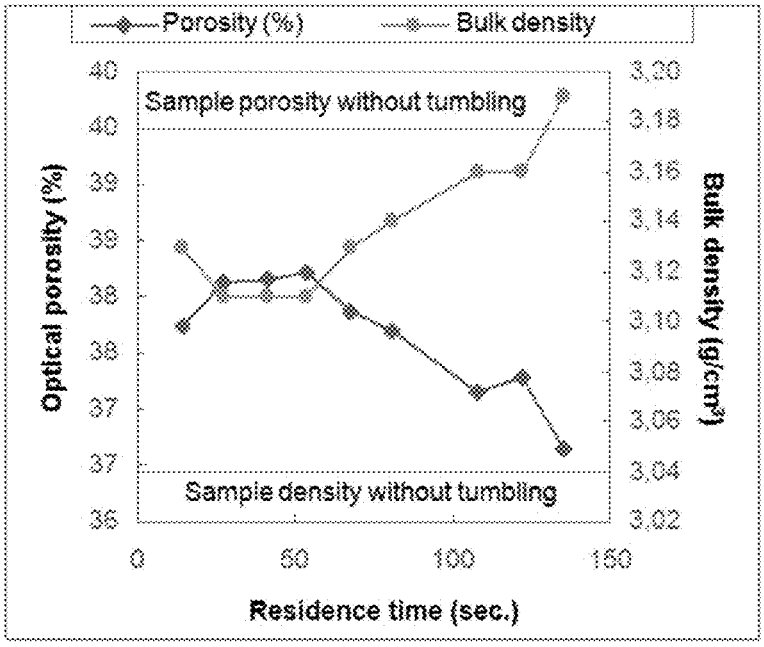
FIG. 8 illustrate a graphic comparing the optical porosity and the bulk density with the residence time inside the DICP.

FIG. 8 shows the comparison results of both density and optical porosity as a function of rotation speed.

It was observed that the highest speed of the pelletizing disc 13 tends to produce denser crude pellets, with better surface finish and less dispersion (variability) in porosity.

Example 2

In order to also set the effect of residence time in the finishing drum 2 on the pellet compactness and densification degree, as well as its porosity, a crude pellet was collected from a given industrial production and subjected to pilot scale tests. It should be highlighted that the finish drum 2 used in this test, which is the second stage of the process (Device for the Improvement of Crude Pellets 1, or DICP 1, as per FIGS. 3-6), was an equipment with dimensions for pilot test, with its inner area measuring 398 mm in diameter per 1100 mm in length, and a supporting structure to sustain the equipment with 5° inclination. The drum's 2 inner side was coated with knurled rubber, at a rotation of 42 rpm. The rolling motion of the pellets inside the drum 2 led to the rearrangement of its mineral particles in such a way that the latter tended to be compacted to minimum porosity. The undesired growth of pellets tended to be at a minimum, as both nucleation and stratification phenomena were virtually inexistent, and there was no ore feed except for some remaining fines, with an intensified coalescence or seed or satellite assimilation phenomenon.

The achieved results were immediately checked for improvements in the sphericity and surface finishing in relation to the pellets that had been previously collected without using the DICP 1, as per the present invention. This present invention conception was further corroborated by the fact that seeds adhered or were integrated to the pellets' surface, thereby demonstrating the assimilation process of part of the fines generated in the discs 13. These fines were either directly assimilated, immediately integrating into the pellets body, or generated seeds that were also integrated to pellets. Together with the results of the first example, a conclusion was drawn that the residence time and the rotation speed are parameters that can be worked on to consolidate the assimilation process, turning both seed and pellet into a single body with no boundary distinction, and also to add greater consistency and such extra quality parameters to pellets as compressive and abrasion strength, sphericity and surface finishing.

Samples were identified as per Table 1, of which six were assessed in relation to each residence time in the drum 2.

TABLE 1

Identification of samples pursuant to the residence time.

| Sample | Residence time (seconds) |
|---|---|
| A | 0 |
| B | 14 |
| C | 27 |
| D | 41 |
| E | 54 |
| F | 68 |
| G | 81 |
| H | 95 |
| I | 108 |
| J | 122 |
| K | 135 |

The samples above, from A to K, were subsamples taken from a single sample of crude pellet collected at a given plant, with sample A not being subjected to tumbling while the remaining ones were tumbled from one to ten times, with a residence time of 13.5 seconds for tumbling each pellet inside the drum 2.

Figure 7:
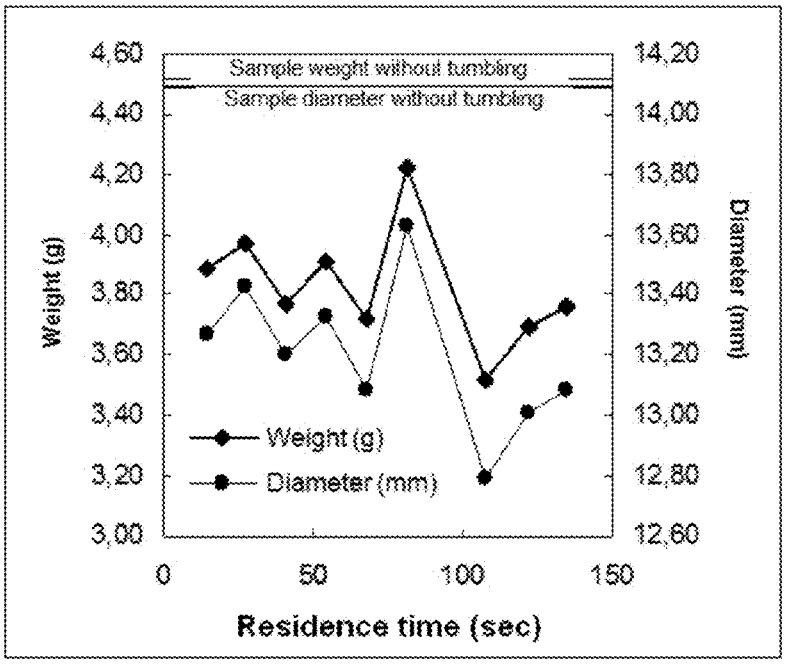
FIG. 7 illustrate a graphic comparing the weigh and diameter of the pellets with the residence time inside the DICP.
Figure 9:
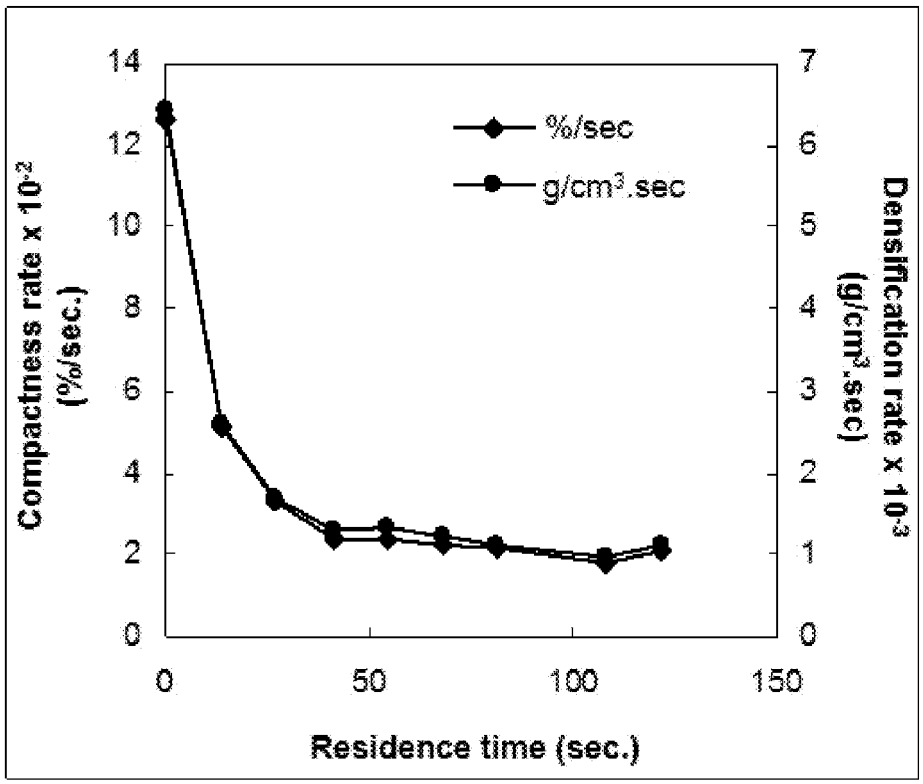
FIG. 9 illustrate a graphic comparing the compactness rate and densification rate with the residence time inside de DICP.

FIGS. 7 to 9 show graphs with the results revealing the sample variation in diameter and weight, pursuant to the residence time (FIG. 7), in addition to pellets porosity and bulk density variation pursuant to tumbling time (FIG. 8), plus the compactness and densification variation rates pursuant to residence time (FIG. 9).

It can be noted that, tumbled samples weight and diameter revealed a tendency to being smaller than those not subjected to tumbling, which might have been due to the loss of both moisture and compactness of the pellet during the process. Tumbled samples showed less porosity and greater bulk density than those not subjected to tumbling. Porosity tended to be reduced, while the bulk density tended to increase as the tumbling time was also increased.

A macroscopic analysis of the six pellets that were investigated in each test also revealed that the pellets produced with different residence times did not show striking macroscopic differences. It is worth pointing out that the desired macrostructural aspects, sphericity and surface finishing were affected by handling and the time needed for carrying out the analyses in distinct geographical locations.

Table 2 shows the optical porosity test results. Mean values, in general, indicated a tendency of decreased optical porosity and an increased bulk density as the residence time inside the drum 2 was increased. On the other hand, the diameter and weight mean values of tumbled pellets were close to each other, showing no meaningful variations with an increased residence time.

TABLE 2

Characterization of crude pellets per optical porosimetry

| Sample | Time (s) | Weight (g) | Diameter (meter) | Porosity (%) | Density (g/cm$^3$) |
|---|---|---|---|---|---|
| A | 0 | 4.52 ± 0.98 | 14.09 ± 1.08 | 39.51 ± 1.06 | 3.04 ± 0.05 |
| B | 14 | 3.89 ± 0.90 | 13.27 ± 0.95 | 37.74 ± 1.02 | 3.13 ± 0.05 |
| C | 27 | 3.97 ± 0.56 | 13.43 ± 0.69 | 38.13 ± 1.52 | 3.11 ± 0.08 |
| D | 41 | 3.77 ± 0.58 | 13.20 ± 0.55 | 38.15 ± 2.01 | 3.11 ± 0.10 |
| E | 54 | 3.91 ± 0.87 | 13.33 ± 0.97 | 38.22 ± 1.28 | 3.11 ± 0.06 |
| F | 68 | 3.72 ± 0.81 | 13.09 ± 0.94 | 37.88 ± 1.36 | 3.13 ± 0.07 |
| G | 81 | 4.22 ± 0.95 | 13.63 ± 1.03 | 37.69 ± 1.04 | 3.14 ± 0.05 |
| H | 95 | 3.98 ± 0.49 | 13.51 ± 0.57 | 39.07 ± 1.11 | 3.07 ± 0.06 |
| I | 108 | 3.52 ± 0.84 | 12.79 ± 0.97 | 37.16 ± 0.55 | 3.16 ± 0.03 |
| J | 122 | 3.69 ± 0.81 | 13.01 ± 0.93 | 37.28 ± 1.57 | 3.16 ± 0.08 |
| K | 135 | 3.76 ± 0.46 | 13.09 ± 0.50 | 36.66 ± 1.20 | 3.19 ± 0.06 |

Note that, the results reveled by the table above, account for the average and standard deviation of the analyses of six pellets per sample type. (*) Further note that, in the case of samples D and H, only five pellets were assessed for each sample.

Accordingly, the examples above substantiate that when crude pellets are tumbled following their being pelletized it leads to the pellets' compactness and densification, that increased as the residence time of the pellet inside the drum 2 is also increased, with compactness and densification rates being, initially, more enhanced with decreased residence times, reducing gradually until they become more stable with greater residence times.

It was also possible to notice increased surface moisture (or moisture exposure) on pellets. This process is due to the rearrangement of particles inside pellets, expelling excess water between the grains that compose pellets. As a result, pellets show higher compactness degree and, consequently, greater mechanical strength.

Although the present invention has been described in details with regards to the exemplary embodiments thereof and accompanying drawings, it should be apparent to those skilled in the art that various modifications of the present invention may be accomplished without departing from the spirit and the scope of the invention. Accordingly, the invention is not limited to the precise embodiments shown in the drawings and described above. Rather, it is intended that all such variations not departing from the spirit of the invention be considered as within the scope thereof as limited solely by the claims appended hereto.

The invention claimed is:

1. A device for the improvement of crude pellets comprising a rotary drum; wherein the rotary drum has an innermost surface that is, at least, partially coated with a simultaneously adherent and elastic material; the rotary drum comprises an internal cleaning system configured to clean the innermost surface of the rotary drum during the operation of the device, and the rotary drum further comprises a longitudinal axle kept at a plane that may vary from a horizontal position to inclined positions in relation to the horizontal plane of the ground and an electromechanical mechanism comprising one electric motor and one reducer capable of adjusting the rotary drum to the inclined positions.

2. The device according to claim 1, wherein the rotary drum innermost surface is smooth.

3. The device for the improvement of crude pellets according to claim 1, wherein the rotary drum innermost surface is striated.

4. The device for the improvement of crude pellets according to claim 1, wherein the longitudinal axle of the rotary drum is kept at inclined positions of about 0° to about 10°.

5. The device for the improvement of crude pellets according to claim 1, wherein the cleaning system comprises a metallic shaft set parallel in relation to the rotary drum's longitudinal axle; the metallic shaft comprising a plurality of radially disposed metallic bristles; the metallic shaft configured to rotate around its own axis of reference.

6. The device for the improvement of crude pellets according to claim 5, wherein the cleaning system is programmed to work on a continuous basis.

7. The device for the improvement of crude pellets according to claim 5, wherein the cleaning system is programmed to work pursuant to the adherence degree of particles on the rotary drum innermost surface.

8. The device for the improvement of crude pellets according to claim 5, wherein the cleaning system comprises a motor with controllable rotation; the motor being capable of rotating up to 150 rpm.

9. The device for the improvement of crude pellets according to claim 5, wherein the cleaning system comprises an electromechanical device, which is set to regulate the distance of the metallic shaft to the innermost surface of the rotary drum.

10. The device for the improvement of crude pellets according to claim 1, further comprising: a discharge chute and a feeding chute, each one of them placed on each of the two longitudinal edges of the rotating drum; each one of them being made of a low attrition and low adherence material.

11. The device for the improvement of crude pellets, according to claim 1, wherein the adherent and elastic material comprises rubber.

12. The device for the improvement of crude pellets, according to claim 11, wherein the adherent and elastic material comprises knurled rubber.

13. The device for the improvement of crude pellets, according to claim 1, wherein the adherent and elastic material comprises polyurethane.

14. The device for the improvement of crude pellets, according to claim 1, wherein the adherent and elastic material comprises polytetrafluoroethylene.

15. The device for the improvement of crude pellets, according to claim 1, wherein the at least partially coated innermost surface has a dynamic attrition rate ranging between 0.05 and 0.60.

16. The device for the improvement of crude pellets, according to claim 1, wherein the thickness of the at least partially coated innermost surface is comprised between 5 and 30 mm.

17. A pelletization process comprising:

pelletizing a given ore or a mixture of ores to produce crude pellets in a first device; and providing induration and conformation to the crude pellets in a second device distinct from the first device, wherein the second device comprises a rotary drum that has an innermost surface; the rotary drum being partially coated with a simultaneously adherent and elastic material; and wherein the rotary drum comprises a cleaning system configured to clean the innermost surface of the rotary drum.

18. The pelletization process according to claim 17, further comprising applying diverse materials on the crude pellets' surface, while the crude pellets roll over the innermost surface.

19. The pelletization process of claim 18, wherein the diverse materials comprise dry, pasty or pulpy finely ground minerals and liquid substances.

20. The pelletization process according to claim 17, wherein the first device comprises a pelletization drum.

21. The pelletization process according to claim 17, wherein the first device comprises a pelletization disc.

22. The pelletization process according to claim 21, wherein the pelletization disc comprises a metallic round tray, with a diameter comprised between 6 and 7 meters, and an inclination ranging from 45° to 50° in relation to the horizontal plane, capable of rotating in the inclined plane at a variable rotation speed ranging from 6 to 7 rpm.

* * * * *